US008380093B2

(12) United States Patent
Shukuya

(10) Patent No.: US 8,380,093 B2
(45) Date of Patent: Feb. 19, 2013

(54) IMAGE FORMING APPARATUS AND IMAGE FORMING METHOD

(75) Inventor: Yuichiro Shukuya, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 168 days.

(21) Appl. No.: 12/805,577

(22) Filed: Aug. 6, 2010

(65) Prior Publication Data

US 2011/0043588 A1 Feb. 24, 2011

(30) Foreign Application Priority Data

Aug. 19, 2009 (JP) ..... 2009-190203

(51) Int. Cl.
*G03G 15/01* (2006.01)

(52) U.S. Cl. ..... 399/39

(58) Field of Classification Search ..... 399/39, 399/298, 299, 300, 302, 303, 306, 308, 312
See application file for complete search history.

(56) References Cited

U.S. PATENT DOCUMENTS 6,219,516 B1 * 4/2001 Furst et al. ..... 399/301
7,411,597 B2 * 8/2008 Noguchi et al. ..... 347/116
7,493,072 B2 2/2009 Sato et al.
2003/0129006 A1 * 7/2003 Hoshi et al. ..... 399/298
2006/0002745 A1 * 1/2006 Iwasaki ..... 399/299
2007/0140721 A1 6/2007 Shinohara et al.
2010/0061752 A1 * 3/2010 Sudo et al. ..... 399/66

FOREIGN PATENT DOCUMENTS

JP 2008-090092 A 4/2008
JP 4359538 B2 8/2009

OTHER PUBLICATIONS

Abstract of JP-2005-292760A which corresponds to JP-4359538-B2.

* cited by examiner

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

An image forming apparatus and image forming method capable of achieving both high-speed printing of less-than-full-color images and high quality printing of multicolor images. The apparatus includes a color shift pattern output unit, a correction amount acquisition unit, and a correction unit to correct at least one or more positions of an image in a sub-scanning direction on a recording medium when a first transfer member transfers an unfixed image and a second transfer member transfers an unfixed image.

7 Claims, 4 Drawing Sheets

IMAGE FORMING APPARATUS AND IMAGE FORMING METHOD

CROSS-REFERENCE TO RELATED APPLICATIONS

The present application claims priority from Japanese patent application number 2009-190203, filed on Aug. 19, 2009, the entire contents of which are hereby incorporated by reference herein.

BACKGROUND OF THE INVENTION

1. Field of the Invention

The present invention relates to an image forming apparatus and image forming method.

2. Discussion of the Related Art

Conventionally, an apparatus such as a printer to form a color image using a tandem structure has been incorporating a technology to correct positional errors in order to match positions of respective colors of the image. For example, JP-2005-292760-A discloses a color image forming apparatus in which, during continuous printing of plural sheets of paper, positional error correction marks are transferred to a conveyer belt or to an intermediate transfer body by lengthening conveyance intervals between successive recording sheets. The advantage of the color image forming apparatus disclosed in JP-2005-292760-A is that it can perform positional error correction during continuous printing operation without stopping the apparatus.

As is known, two transfer methods are available in the image forming apparatus: an intermediate transfer method and a direct transfer method. The intermediate transfer has the advantage of creating fewer positional errors between transferred colors compared to the direct transfer. By contrast, the direct transfer, if used in the image formation of fewer colors of toner, such as monochrome image formation or two-color image formation, can reduce the time taken to output media on which such less-than-full-color images are formed.

In addition, JP-2008-90092-A discloses an invention related to an image forming apparatus configured to include both the intermediate transfer body and the direct transfer body. Specifically, the same discloses a technology to set the time that the image transferred to the intermediate transfer body reaches the position for the direct transfer to be an integral multiple of the time taken for one cycle of rotation of the intermediate transfer body, thereby reducing the positional error of the transferred image due to deviation in the rotation speed of the rotational body.

However, the same does not consider scaling errors in a sub-scanning direction. In the structure including the both intermediate transfer and the direct transfer, the speed of the intermediate transfer and that for conveying a paper medium at the side of the direct transfer are not necessarily the same. Then, this difference in speed causes sub-scanning scaling errors.

For these reasons, a need exists for an image forming apparatus including both the intermediate transfer body and the direct transfer body capable of solving the aforementioned conventional problems of the sub-scanning scaling errors while providing both high-speed printing of the less-than-full-color color images and high-quality multicolor image printing collaterally.

SUMMARY OF THE INVENTION

Accordingly, the present invention provides a novel image forming apparatus configured to include a color shift pattern output unit, a correction amount acquisition unit, and a correction unit. The color shift pattern output unit causes a first transfer member to transfer a color shift correction pattern on a conveying belt to convey a recording medium, and a second transfer member, arranged downstream of the first transfer member in the recording medium conveying direction, to transfer an unfixed image transferred to a first intermediate transfer member to the recording medium, and a third transfer member to transfer the color shift correction pattern to the first intermediate transfer member. The correction amount acquisition unit obtains a correction amount when performing positional error correction in the sub-scanning direction between the unfixed image that the first transfer member transfers and the unfixed image that the second transfer member transfers, based on the color shift correction pattern transferred to the first intermediate transfer member from the conveying belt and the color shift correction pattern transferred to the first intermediate transfer member by the third transfer member. The correction unit is configured to correct at least one color shift error in the image in the recording medium among the color shift errors in the sub-scanning direction occurring when the first transfer member transfers an unfixed image and when the second transfer member transfers an unfixed image.

Thus, the image forming apparatus and the image forming method employed therein achieves both high speed in the less-than-full-color image printing and high quality in the multicolor image printing.

These and other objects, features and advantages of the present invention will become apparent upon consideration of the following description of the preferred embodiments of the present invention when taken in conjunction with the accompanying drawings.

DESCRIPTION OF THE PREFERRED EMBODIMENTS

An embodiment of the present invention will now be described with reference to drawings.

Figure 1:
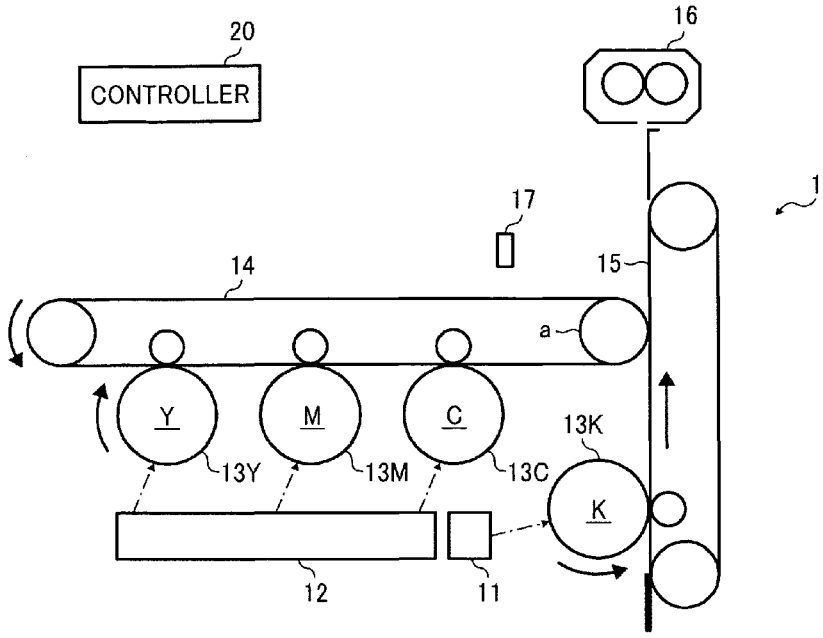
FIG. 1 is a diagram showing a structure of an engine section of an image forming apparatus according to an embodiment of the present invention.

FIG. 1 is a diagram showing an engine section 1 of an image forming apparatus as an exemplary embodiment of the invention. The engine section 1 is configured to perform both direct transfer and indirect transfer via an intermediate transfer belt. More specifically, an image formed using black (K) toner is transferred to a recording sheet by the direct transfer, whereas an image formed using toner of yellow (Y), magenta (M), and cyan (C) is first transferred to the intermediate transfer belt and then transferred to the recording sheet.

The engine section 1 uses the configuration dedicated to the direct transfer in a case of monochrome printing, and therefore, a speedier output can be performed than in a method using the intermediate transfer. In the case of color printing, the configuration of the intermediate transfer is used for the colors other than black (K), and therefore, positional errors between those colors transferred via intermediate transfer can be reduced. This is because each recording sheet may be possibly in a different position relative to a photoreceptor on the sheet feeding path, but the intermediate transfer belt takes a constant position relative to the photoreceptor. In addition, the intermediate transfer has an advantage of reducing the occurrence of sheet jams with its simplified feeding path for the recording sheet compared to the direct transfer.

The engine section 1 includes a first writing unit 11, a second writing unit 12, a photoreceptor 13K, a photoreceptor 13Y, a photoreceptor 13M, a photoreceptor 13C, an intermediate transfer belt 14, a sheet conveying belt 15, a fixing unit 16, a color shift detection sensor 17, and a controller 20.

The writing unit 11 forms a latent image on the photoreceptor 13K and causes the latent image to be developed with toner. The writing unit 12 forms a latent image on each of the photoreceptors 13Y, 13M, and 13C to cause the latent image to be developed with toner. The photoreceptor 13K forms a latent image of the color black (K). The latent image formed on the photoreceptor 13K is, after being developed, transferred to the recording sheet conveyed by the sheet conveying belt 15 as an unfixed image.

The writing unit 12 forms a latent image on each of the photoreceptors 13Y, 13M, and 13C. A yellow (Y) latent image is formed on the photoreceptor 13Y, a magenta (M) latent image is formed on the photoreceptor 13M, and a cyan (C) latent image is formed on the photoreceptor 13C. The latent images formed on these three photoreceptors 13Y, 13M and 13C are, after being developed, transferred to the intermediate transfer belt 14.

The intermediate transfer belt 14 allows the unfixed image transferred from the photoreceptors 13Y, 13M, and 13C to be transferred to the recording sheet which has been conveyed by the sheet conveying belt 15 at a contact point "a". The contact point "a" is the point at which the intermediate transfer belt 14 and the sheet conveying belt 15 contact each other.

The fixing unit 16 heats, with pressure, the recording sheet on which the unfixed image has been transferred, thereby fusing and fixing toner deposited on the unfixed image to fix the image on the recording sheet.

The color shift detection sensor 17 detects marks for color shift correction (hereinafter "color shift correction pattern") transferred to the intermediate transfer belt 14 and the sheet conveying belt 15. Based on the detected color shift correction pattern, a correction amount is computed, whereby a sub-scanning scaling error between the intermediate transfer belt 14 and the sheet conveying belt 15 can be corrected.

The controller 20 corrects the sub-scanning scaling error based on the color shift correction pattern detected by the color shift detection sensor 17. In addition, the controller 20 causes the color shift correction pattern to be output from the writing unit 11 and the writing unit 12.

In the present embodiment, the color shift correction pattern is output from both transfer sections, the direct transfer side and the intermediate transfer side. The color shift correction pattern K of the direct transfer side is transferred from the photoreceptor 13K to the sheet conveying belt 15. The color shift correction pattern K is then transferred to the intermediate transfer belt 14 at the contact point "a".

The color shift correction patterns CMY of the intermediate transfer side include patterns corresponding to each color of C, M and Y. The color shift correction patterns CMY are each generated by being output from the corresponding photoreceptors 13Y, 13M and 13C. In correcting the sub-scanning scaling error, all three colors need not used and instead only one color among the three may be used.

Figure 2:
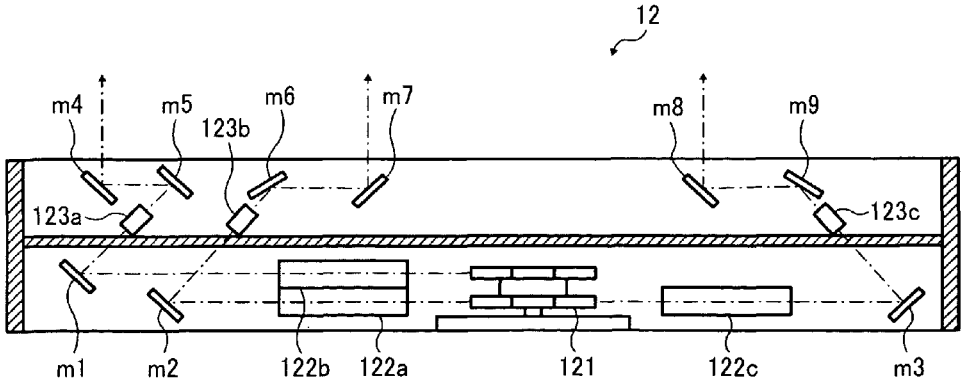
FIG. 2 is a diagram illustrating an exemplary configuration of a writing unit shown in FIG. 1.

FIG. 2 is a diagram showing an exemplary configuration of the writing unit 12. The writing unit 12 forms images of three colors C, M, and Y, and includes a polygon mirror 121, fθ lenses 122*a* through 122*c*, mirrors m1 through m9, and long toroidal (WTL) lenses 123*a* through 123*c*.

Laser beams of respective colors which have passed through a WTL lens, not shown in the figure, are directed onto the polygon mirror 121. The WTL lens has a predetermined refractive index in the sub-scanning direction and focuses the laser beams toward the sub-scanning direction.

The polygon mirror 121 is rotated at a high speed by a motor, not shown, and deflects the incident laser beams in the main scanning direction. Accordingly, the laser beams are scanned in the main scanning direction, and the laser beams are focused, depending on the color, onto any one of the fθ lenses 122*a* through 122*c*. The focused laser beams are subjected to an optical face tangle correction due to the polygon mirror 121 for each color, and thereafter, the laser beams are output to the corresponding. photoreceptors 13Y, 13M, and 13C.

Herein, the writing unit 12 is used for forming images of three colors of C, M, and Y, but alternatively may be used for forming images of four colors of C, M, Y, and K. In a case where the writing unit 12 is used for forming four colors of images, for example, a construction in which the laser unit, mirrors, and lenses are provided symmetrically on both sides of the polygon mirror 121 may be employed. In this case, the writing unit 11 may be omitted in the construction of the engine section 1.

Alternatively, the engine section 1 can be formed such that a writing unit for each color of C, M, Y, and K is provided. In this case, each writing unit needs a polygon mirror to deflect laser beams and an optical system including lenses and mirrors.

Figure 3:
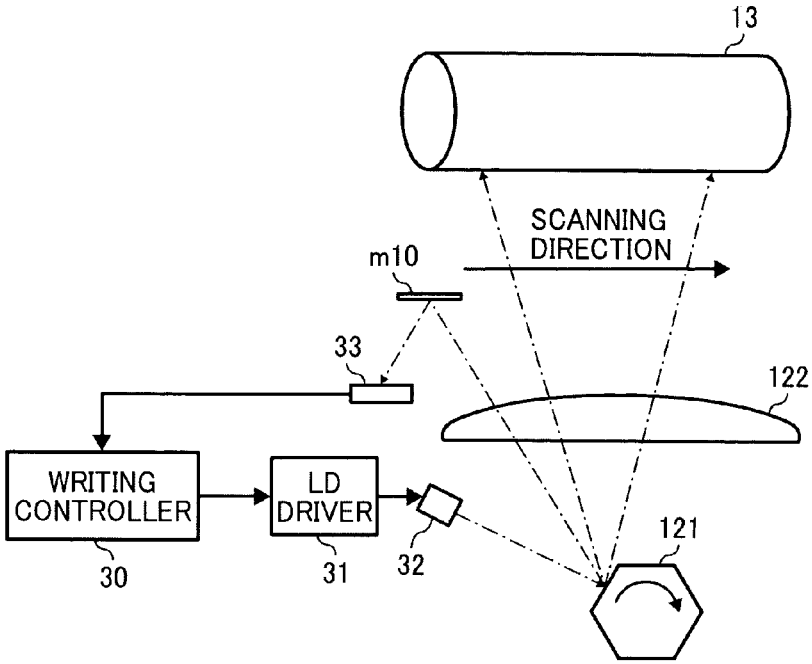
FIG. 3 is a diagram illustrating an optical system of the writing unit.

FIG. 3 is a diagram showing an optical system of the writing unit 12. The optical system as illustrated in FIG. 3 corresponds to any one color among the four colors C, M, Y, and K. The optical system includes a polygon mirror 121, an fθ lens 122, a photoreceptor 13, a mirror m10, a synchronization detection sensor 33, a writing controller 30, a laser diode (LD) driver 31, and a laser diode 32.

The laser beam incident to the polygon mirror 121 from the laser diode 32 is deflected in the main scanning direction. The "scanning direction" indicated in the figure shows the main scanning direction. The light beam deflected in the main scanning direction strikes the synchronization detection sensor 33 via the mirror m10 provided at one end of the optical path, whereby a timing of the laser beam is detected. The detected timing signal is input to the writing controller 30.

The writing controller 30 drives the LD driver 31 based on the input timing signal. The timing of the laser beam oscillated by the laser diode 32 can thus be controlled.

If the mirror m10 is provided at both ends of the optical path and the timings of two colors of laser beams are detected by one mirror, timing control of a maximum of four colors of laser beams can be performed.

Figure 4:
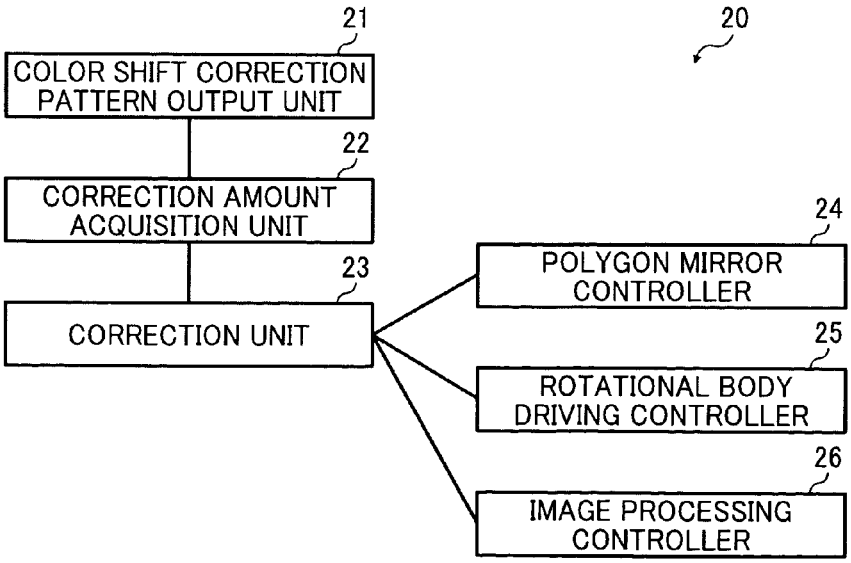
FIG. 4 is a block diagram showing an example of a functional configuration of a controller included in the image forming apparatus.

FIG. 4 is a block diagram showing an example of a functional construction of the controller 20 included in the image forming apparatus according to an embodiment of the present invention. The controller 20 illustrated in FIG. 4 performs sub-scanning scaling error correction based on the information detected from the output color shift correction pattern.

The controller 20 includes a color shift correction pattern output unit 21, a correction amount acquisition unit 22, and a correction unit 23. The controller 20 may further include a polygon mirror controller 24, a rotational body driving controller 25, or an image processing controller 26.

The color shift correction pattern output unit 21 outputs color shift correction patterns to be transferred to the sheet conveying belt 15 and the intermediate transfer belt 14. The output color shift correction patterns include color shift correction patterns CMY, corresponding to any one or more colors of Y, M, or C for which the intermediate transfer is performed, and a color shift correction pattern K, corresponding to the color K for which the direct transfer is performed. The color shift correction pattern K transferred from the photoreceptor 13K to the sheet conveying belt 15 is transferred to the intermediate transfer belt 14.

Figure 5:
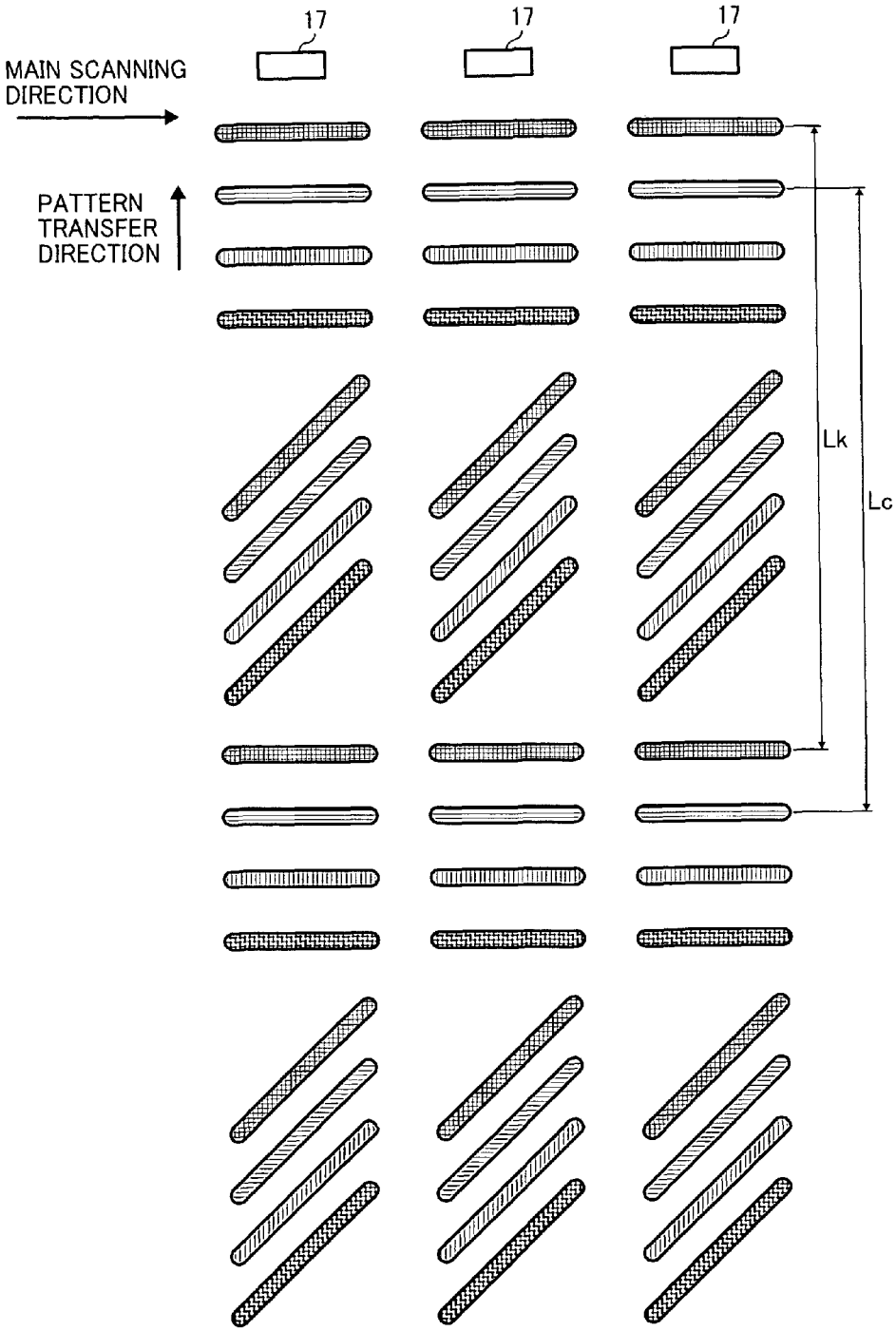
FIG. 5 is a diagram showing examples of color shift correction pattern CMY and color shift correction pattern K.

FIG. 5 is a drawing showing an example of color shift correction patterns CMY and color shift correction pattern K transferred to the intermediate transfer belt 14. As illustrated in FIG. 5, uppermost marks are color shift correction pattern K. In FIG. 5, the same color shift correction patterns corresponding to each of Y, M, C, and K have the same type of hatching.

In FIG. 5, the vertical direction is the direction parallel to the sub-scanning direction and the horizontal direction is the direction parallel to the main scanning direction. Three rows of color shift correction patterns are arranged in the sub-scanning direction and both horizontal line patterns and oblique line patterns are provided. Three color shift detection sensors 17 are provided, with each sensor corresponding to each row.

With the above structure, other than the sub-scanning scaling error, skew from a reference color, sub-scanning registration error, main scanning registration error, and main scanning scaling error can be obtained. Further, based on the measured values of the three-point positions or distances among color shift correction patterns, the scanning line distortion can be detected, whereby the sub-scanning registration correction can be optimized.

Returning to FIG. 4, the correction amount acquisition unit 22 obtains a correction amount to correct the sub-scanning scaling error based on the amount that the color shift detection sensor 17 detects from the color shift correction pattern.

The correction amount to correct the sub-scanning scaling error can be obtained from the distance between colors of the horizontal patterns included in the color shift correction pattern. More specifically, by obtaining the difference in the distance between colors, the correction amount of the sub-scanning scaling error can be obtained.

The sub-scanning scaling error occurs due to deviation between the timing to transfer images to the recording medium and the timing to transfer images from the intermediate transfer belt 14 to the recording medium. The deviation in the timing, between three colors of Y, M, and C, of transferring images to the intermediate transfer belt 14 is negligible and is not considered further. Then, the sub-scanning scaling error between any one of the three colors in the intermediate transfer side and one color in the direct transfer side will now be corrected.

The sub-scanning scaling error is the deviation in intervals of the horizontal patterns of the color different in the transfer method from that of the reference color. Here, the reference color is set as cyan (C). In this case, cyan (C) is the color to be transferred to the intermediate transfer belt 14. Then, the black (K) which will be transferred from the sheet conveying belt 15 to the intermediate transfer belt 14 should be the color to be compared.

In FIG. 5, a length Lk is a distance between the horizontal patterns of the color shift correction pattern K. In addition, the length Lc is a distance between the horizontal patterns of the color shift correction pattern C of the color shift correction patterns CMY. Then, the sub-scanning scaling error can be represented by the following formula:

$$\text{Sub-scanning scaling error} = Lk/Lc \quad (1)$$

In the formula (1), Lk and Lc are values represented by units of either length or time.

Returning to FIG. 4, the correction unit 23 corrects the sub-scanning scaling error by the correction amount obtained by the correction amount acquisition unit 22. The correction unit 23 outputs instruction to anyone or more controllers among the polygon mirror controller 24, the rotational body driving controller 25 and the image processing controller 26.

The polygon mirror controller 24 corrects a rotation speed of a polygon motor, not shown, to drive and rotate the polygon mirror 121. According to this, the sub-scanning scaling error can be corrected. The relation between the rotation speed of the polygon motor and the sub-scanning scale is as follows:

(1) Correction to Reduce the Rotation Speed of the Polygon Motor

In this case, the time to write one main scanning line is lengthened and the distance that the photoreceptor rotates while writing one main scanning line is also lengthened. Accordingly, the sub-scanning scale is increased. (That is, the image expands in the sub-scanning direction.)

(2) Correction to Increase the Rotation Speed of the Polygon Motor

In this case, the time to write one main scanning line is shortened and the distance that the photoreceptor rotates while writing one main scanning line is also shortened. Accordingly, the sub-scanning scale is reduced. (That is, the image shrinks in the sub-scanning direction.)

To perform the correction above, different polygon motors need to be provided for the intermediate transfer side and the direct transfer side, because if the plurality of colors of image writing is performed using a single polygon motor, the sub-scanning scale correction cannot be performed with respect to and between the colors sharing the same polygon motor.

As between the intermediate transfer side and the direct transfer side, it is effective to perform the sub-scanning scaling error correction to the less-than-full-color because there are fewer parameters used for correction. In the present embodiment, the rotation speed of the polygon motor for black (K) is corrected as follows. Assume that the current rotation speed is set to be Rpg_k [rpm], and the rotation speed after correction is set to be Rpg_k' [rpm]. Then, Rpg_k' can be obtained by the following formula (2):

$$Rpg_k' = Rpg_k \times Lk/Lc \quad (2)$$

According to the correction by the formula (2), the sub-scanning scale of the black (K) side is so corrected as to match the sub-scanning scale of the CMY side.

It should be noted that, if the rotation speed of the polygon motor is changed, control of the main scanning direction is also affected. Then, a pixel clock frequency controlling the main scanning direction needs to be changed accordingly. Assuming that the pixel clock frequency before the correction relative to the color black (K) is fk [MHz], and the pixel clock frequency after the correction is set to be fk' [MHz], then the fk' can be obtained by the following formula (3):

$$fk' = fk \times Lk/Lc \quad (3)$$

By performing two corrections by the formulas (2) and (3), the sub-scanning scaling error can be corrected without affecting the main scanning direction.

The rotational body driving controller 25 corrects a rotational speed of the photoreceptor 13. Accordingly, the sub-scanning scaling error can be corrected.

In a case where the sub-scanning scale of the black (K) side is matched using the sub-scanning scale of the CMY side as a reference, the rotation speed Vk' [rad/s] of the photoreceptor 13K for the black (K) after correction may be obtained as follows, with the rotation speed before correction set as Vk [rad/s]:

$$Vk'=Vk\times Lk/Lc \quad (4)$$

By contrast, in a case where the sub-scanning scale of the CMY side is matched using the sub-scanning scale of the black (K) side as a reference, the rotation speed Vm' [mm/s] of the intermediate transfer belt after correction may be obtained as follows, with the rotation speed before correction set as Vm [mm/s]:

$$Vm'=Vm\times Lc/Lk \quad (5)$$

If the sub-scanning scaling error is corrected by the rotation speed of the polygon motor, at least one polygon motor needs to be provided to each side of the intermediate transfer and the direct transfer. However, by correcting the rotation speed of the photoreceptor 13, even though only a single polygon motor is provided, the sub-scanning scaling error can still be corrected.

The image processing controller 26 provides the thus-obtained sub-scanning scaling error, as feedback, to the image processing, and processes the to-be-formed image and finely adjusts the sub-scanning scale of the to-be-printed image itself.

In a case where the sub-scanning scale of the black (K) image is matched with that of the CMY image, specifically, image processing such that the sub-scanning length of the Bk image becomes to be equal to Lc/Lk is performed. By contrast, in a case where the sub-scanning scale of the CMY image is matched with that of the black (K) image, image processing such that the sub-scanning length of the CMY image becomes to be equal to Lk/Lc is performed.

When correcting the sub-scanning scale by image processing, it is preferred that the writing system be configured to write images using a plurality of light beams for each color. This is because when performing correction by the image processing, a single light beam in the ordinary configuration cannot perform correction at a resolution exceeding the maximum writing resolution in the sub-scanning direction.

Then, what is recommended is providing a configuration to write an image using the plurality of light beams for each color and narrowing the pitch between beams in the sub-scanning direction, whereby the maximum writing resolution in the sub-scanning direction can be increased.

Meanwhile, the sub-scanning scale correction by the image processing is possible even with a configuration in which the image is written using a single optical beam. However, in this case, there is a possibility that unevenness in the sub-scanning direction occurs.

Figure 6:
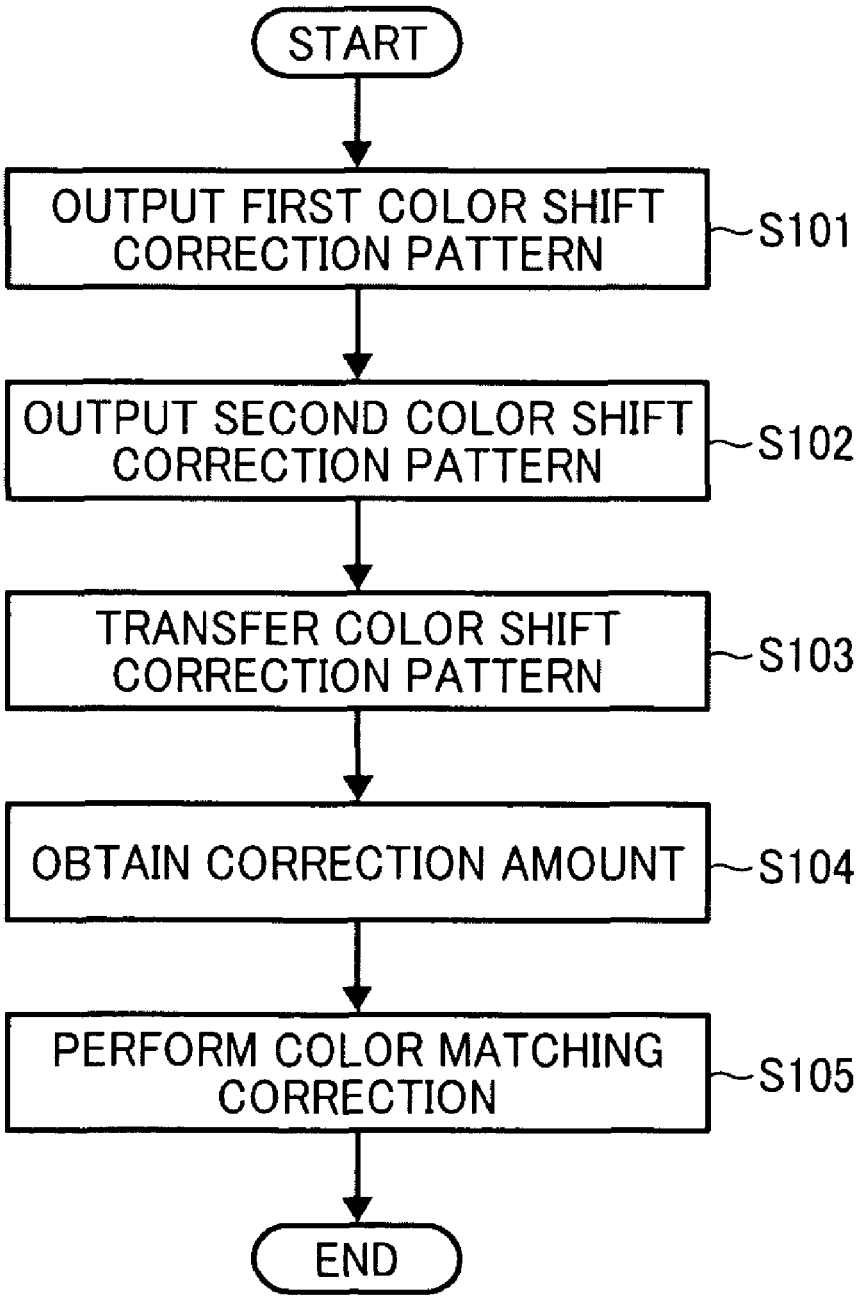
FIG. 6 is a flowchart explaining an image forming method according to an embodiment of the invention.

FIG. 6 is a flowchart to explain how to form images according to an embodiment of the present invention. As illustrated in FIG. 6, the color shift correction pattern output unit 21 outputs a first color shift correction pattern to, for example, the direct transfer side, in Step S101. Accordingly, the first color shift correction pattern is transferred onto the sheet conveying belt 15.

Next, in Step S102, the color shift correction pattern output unit 21 outputs a second color shift correction pattern, for example, to an intermediate transfer side. Accordingly, the second color shift correction pattern is transferred onto the intermediate transfer belt 14.

Subsequently, in Step S103, the sheet conveying belt 15 and the intermediate transfer belt 14 are driven to rotate, whereby the color shift correction pattern transferred onto either of the direct and intermediate transfer sides is again transferred to another side. Specifically, the color shift correction pattern on the sheet conveying belt 15 is transferred to the intermediate transfer belt 14, for example.

Then, in Step S104, the correction amount acquisition unit 22 obtains a correction amount to be used for correcting the sub-scanning scaling error, based on the two color shift correction patterns transferred to another side in Step S103. The correction amount may be calculated by, for example, the formula (1).

The process proceeds to Step S105, wherein the correction unit 23 performs color matching correction depending on the correction amount obtained in Step S104. This color matching correction corresponds to the correction of the sub-scanning scaling error for each color, and can be performed according to any method using any one of the formulae (2) through (4).

In the above embodiment, the position of the contact point "a" in the engine section 1 is provided in the downstream side of the photoreceptor 13K for the direct transfer. However, the position of the contact point "a" is not limited to this embodiment, and the intermediate transfer belt 14 may be provided at an upstream side of the photoreceptor 13K. In this case, the color shift correction pattern transferred to the intermediate transfer belt 14 is first transferred to the sheet conveying belt 15, and thereafter, is compared with the color shift correction pattern transferred by the photoreceptor 13K. With this configuration, the correction amount for use in correcting the sub-scanning scaling error is obtained.

In addition, instead of the photoreceptor 13K performing the direct transfer, a transfer section to transfer images via the intermediate transfer belt can be provided. According to this configuration, the difference in the sub-scanning scaling errors of the images transferred from two intermediate transfer belts can be corrected. The configuration including two intermediate transfer belts can respectively reduce a positional shift between colors of the image to be transferred to the same intermediate transfer belt.

The image forming apparatus related to the present embodiment of the invention can be implemented by a personal computer (PC) or the like. In addition, the image forming method related to the present invention can be implemented by a CPU according to a program stored in, for example, a ROM, a hard disk drive, and the like, using a main memory such as a RAM as a work area.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a color shift pattern output unit to cause:

a first transfer member, configured to develop a latent image formed on a photoreceptor by light exposure and transfer an unfixed image to a recording medium, to transfer a color shift correction pattern on a conveying belt to convey the recording medium;

a second transfer member, arranged downstream of the first transfer member in the recording medium conveying direction, to transfer an unfixed image transferred to a first intermediate transfer member to the recording medium; and a third transfer member to transfer the color shift correction pattern to the first intermediate transfer member, a correction amount acquisition unit to obtain a correction amount when performing positional error correction in the sub-scanning direction between the unfixed image that the first transfer member transfers and the unfixed image that the second transfer member transfers, based on the color shift correction pattern transferred to the first intermediate transfer member from the conveying belt and the color shift correction pattern transferred to the first intermediate transfer member by the third transfer member; and a correction unit configured to correct at least one color shift error in the image in the recording medium among color shift errors in the sub-scanning direction occurring when the first transfer member transfers an unfixed image and when the second transfer member transfers an unfixed image.

2. The image forming apparatus as claimed in claim 1, wherein the correction unit is configured to correct a speed of a light beam output by a first deflecting unit to deflect the light beam into a main scanning direction when forming a latent image related to the first transfer member and a second deflecting unit to deflect the light beam into the main scanning direction when forming a latent image related to the third transfer member.

3. The image forming apparatus as claimed in claim 1, wherein the correction unit is configured to correct at least one of a speed in the sub-scanning direction when the first transfer member transfers an unfixed image to the recording medium, and a speed in the sub-scanning direction when the second transfer member transfers the unfixed image from the first intermediate transfer member to the recording medium, and a speed in the sub-scanning direction when the third transfer member transfers the unfixed image to the first intermediate transfer member.

4. The image forming apparatus as claimed in claim 1, wherein the correction unit is configured to correct at least one of a length of a sub-scan when the first transfer member forms a latent image and a length of a sub-scan when the third transfer member forms a latent image.

5. The image forming apparatus as claimed in claim 1, wherein the first transfer member transfers the unfixed image to the first intermediate transfer member, to the recording medium.

6. An image forming apparatus comprising:

a color shift pattern output unit to cause:

a first transfer member, configured to develop a latent image formed on a photoreceptor by light exposure and transfer an unfixed image to a recording medium, to transfer a color shift correction pattern on a conveying belt to convey the recording medium;

a second transfer member, arranged upstream of the first transfer member in the recording medium conveying direction, to transfer an unfixed image transferred to a first intermediate transfer member to the recording medium; and a third transfer member to transfer the color shift correction pattern to the first intermediate transfer member, a correction amount acquisition unit to obtain a correction amount when performing positional error correction in the sub-scanning direction between the unfixed image that the first transfer member transfers and the unfixed image that the second transfer member transfers, based on the color shift correction pattern transferred to the first intermediate transfer member from the conveying belt and the color shift correction pattern transferred to the first intermediate transfer member by the third transfer member; and a correction unit configured to correct at least one color shift error in the image in the recording medium among color shift errors in the sub-scanning direction occurring when the first transfer member transfers an unfixed image and when the second transfer member transfers an unfixed image.

7. An image forming method comprising:

a first transfer step executed by a first transfer member configured to develop a latent image formed on a photoreceptor by light exposure and transfer an unfixed image to a recording medium, to transfer a color shift correction pattern on a conveying belt to convey the recording medium;

a second transfer step to cause a second transfer member, arranged downstream of the first transfer member in the recording medium conveying direction, to transfer an unfixed image transferred to a first intermediate transfer member to the recording medium;

a second color shift pattern transfer step by a third transfer member to transfer the color shift correction pattern to the first intermediate transfer member;

a third color shift pattern transfer step to transfer the color shift correction patter transferred in the first transfer step from the conveying belt to the first intermediate transfer member;

a correction amount acquisition step to obtain a correction amount when performing positional error correction in the sub-scanning direction between the unfixed image that the first transfer member transfers and the unfixed image that the second transfer member transfers, based on the color shift correction pattern transferred to the first intermediate transfer member from the conveying belt and the color shift correction pattern transferred to the first intermediate transfer member by the third transfer member; and a correction step configured to correct at least one color shift error in the image in the recording medium among color shift errors in the sub-scanning direction occurring when the first transfer member transfers an unfixed image and when the second transfer member transfers an unfixed image.

* * * * *